United States Patent [19]

Dieckmann et al.

[11] Patent Number: 4,773,684

[45] Date of Patent: Sep. 27, 1988

[54] DOOR FITTING WITH DOOR OPERATING UNIT AND COVER PLATE

[75] Inventors: Dieter Dieckmann, Renchen, Fed. Rep. of Germany; Jacques Chiri, Bischwiller, France

[73] Assignee: Normbau, Inc., Addison, Ill.

[21] Appl. No.: 27,481

[22] Filed: Mar. 17, 1987

[30] Foreign Application Priority Data

May 2, 1986 [DE] Fed. Rep. of Germany ..... 3614952

[51] Int. Cl.[4] ..... E05B 15/02

[52] U.S. Cl. ..... 292/357; 292/350; 292/351; 292/348; 292/DIG. 2

[58] Field of Search ..... 292/357, 351, DIG. 2, 292/347, 356, 350, 348

[56] References Cited

U.S. PATENT DOCUMENTS

| | | | |
|---|---|---|---|
| 286,614 | 10/1883 | Hughes | 292/357 |
| 470,072 | 1/1892 | Ormsby | 292/357 |
| 1,209,037 | 12/1916 | Rosenfeld | 292/357 |
| 2,676,049 | 4/1954 | Wurzel | 292/357 |
| 2,842,952 | 7/1958 | Russell | 292/347 |
| 3,228,279 | 1/1966 | Sampson | 411/508 X |
| 4,597,600 | 7/1986 | Wilke et al. | 292/351 X |

FOREIGN PATENT DOCUMENTS

| | | | |
|---|---|---|---|
| 1952405 | 6/1971 | Fed. Rep. of Germany | 292/351 |
| 2969 | of 1861 | United Kingdom | 292/357 |
| 1156 | of 1886 | United Kingdom | 292/357 |
| 3434 | of 1894 | United Kingdom | 292/348 |

*Primary Examiner*—Gary L. Smith
*Assistant Examiner*—Curtis B. Brueske
*Attorney, Agent, or Firm*—Milton S. Gerstein; Marvin N. Benn

[57] ABSTRACT

The invention relates to a door fitting with at least one door operating unit, such as a doorknob, a door handle or the like, and at least one cover plate to cover the opening provided in a door, a window sash or the like for the door operating unit, in which the cover plate has at least one round opening for the door operating unit. Primarily in order to secure the door handle against being pulled off, but also in order to help secure the door handle against canting, the invention provides that the door operating unit for such a door fitting has a cylindrical circumferential groove in the area going through the opening in the cover plate when installed, and that the cover plate consists of at least two parts with curved recesses having inner shoulders that are adapted to the groove and which can be inserted into same, and that the curved recesses combine to form a circular opening in the cover plate when the pieces are combined.

6 Claims, 2 Drawing Sheets

DOOR FITTING WITH DOOR OPERATING UNIT AND COVER PLATE

BACKGROUND OF THE INVENTION

The invention relates to a door fitting with at least one door operating unit, such as a doorknob, a door handle or the like, and at least one cover plate to cover the opening provided in the door, the window sash or the like, for the door operating unit, whereby the cover plate has at least one circular opening for the door operating unit and whereby the cover plate may be shaped, primarily, as a so-called rosette, but also as short or long covers or the like.

Cover plates for such door fittings are, in principle, found in the following German patents, DE-PS No. 11 68 793; GN-PS No. 12 36 574; DE-05 15 53 324; DE-GM No. 19 06 410; and DE-GM No. 19 35 386.

Doorknobs and door handles of such types are generally fastened and secured against being pulled off by having a many-sided operating bolt, which projects through the door panel or the like, fastened in a handle piece while another piece is pushed onto it and pinned to the polygonal spindle, e.g. as shown in DE-PS No. 10 39 703.

The assembly of such known door fittings takes place by first attaching the cover plate, which may consist of several pieces, to the door, e.g., by first screwing a cover plate underpiece onto the door and then fastening an outer cover on top. The door handle equipped with a polygonal spindle is then inserted, whereby the spindle goes through the door and projects from the opposite side of the door. Then another door handle is inserted on the spindle on that side and pinned in place. One disadvantage of such a procedure is that is is difficult and expensive to center the cover plate in relation to the polygonal opening in the lock through which the spindle is inserted and with which it works together to operate the locking device. An off-center installation may easily occur making the placement of the handle more difficult or even impossible, so that the cover plate may have to be removed and installed once again. Also, the pinning of the two door handles is unaesthetic. The pinning method must take into consideration that door panels may have different thicknesses, e.g., the pin in a long hole is secured by friction. This, however, can easily lead to loosening of the handle attachment so that the door handle wobbles in the door. In particular, the hold of the door handle may be affected, not just in the axial direction, but also with respect to canting or the like.

SUMMARY OF THE INVENTION

The objective of the invention is, therefore, to provide a door fitting which—while avoiding the above-mentioned disadvantages—ensures a safe, aesthetic and visually impeccable fastening of the door handle onto a door, especially with respect to its being pulled off; but also with respect to canting and the like.

Said task is accomplished according to the invention for a door fitting of the type mentioned in the beginning by the fact that the door operating unit has a cylindrical circumferential groove in the area passing through the opening of the cover plate when installed, and by the fact that the cover plate consists of at least two parts with curved recesses with inner shoulders which match the groove and which can be inserted into the latter, whereby the curved recesses combine to form a circular opening in the cover plate when the parts are put together.

By outfitting the door handle with a circumferential groove into which the two halves with curved recesses are placed in such a manner that the edges of the recesses fit precisely into the groove, a secure attachment of the door handle, especially in the axial direction, is obtained regardless of the thickness of the door after the cover plate pieces have been screwed onto the door. An outer cover, which covers the curved cover plate pieces, may also be provided in the usual manner. While, in principle, the cover plate may consist of several curved or arch-shaped pieces which always add up to a full circle, a preferred construction provides that the cover plate consists of two halves with semicircular recesses. The two halves are then placed against each other in such a manner that their semi-circular recesses, which form a complete circle when combined, encircle the door handle, especially in the area of its groove, and protect it from being pulled off in the axial direction. The semicircular parts can either be attached to each other simply by screwing onto the door, or have corresponding connecting parts, preferably snap-in devices.

In a further, greatly-preferred embodiment, an additional part, with a dish-shaped recess adapted to the shape of the parts, is provided, which, at least partially, overlaps the two parts, thereby holding together the two semi-circular parts radially, and the curved parts and the part overlapping them have shaped projections to position the parts at the correct angle in relation to each other. In this connection, the additional cover plate piece or intermediate piece is placed on the end receiving the polygonal spindle for actuation of the door closing device, preferably on a part with a smaller diameter, so that it rests on a shoulder of the door handle. Then the two halves are inserted one after the other into the opening of the intermediate part in such a manner that their inner periphery (shaped like a projection), catches into the groove of the door handle. This is basically very easily done in said construction according to the invention, and further facilitated by the fact that the recess has cylindrical, sloping inner walls so that it is, itself, shaped more or less as a truncated cone. Other embodiments provide for the overlapping part to have a tap in the circumference of its opening which interlocks with a radial recess near the periphery of the parts and for the overlapping part to have holes corresponding to the perforations in the ring area of the curved parts for reception of the fastening screws with which the parts can be attached to a door or the like, and/or for the holes in the overlapping piece to be enlarged on the side facing away from the parts in order to receive the head of a fastening screw.

If an additional outer cover is provided, it is preferably attached resting on the other parts, either in the curved parts or, if provided, on the above-mentioned intermediate piece. The outer cover has a shaped recess at the inner periphery of its cylinder-shaped circumferential flange which works together with a corresponding shaped recess in one of the other parts so that the outer cover is retained from behind.

BRIEF DESCRIPTION OF THE DRAWINGS

Further advantages and features of the invention are given in the claims and in the following description in which, by way of example, an embodiment of the door fitting according to the invention is described in detail. The figures show:

Figure 1B:
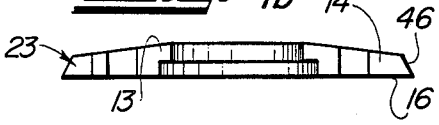
FIG. 1 shows a two-part underpiece of a multiple-part cover plate of the present invention, in (*a*) a plan view.
Figure 1A:
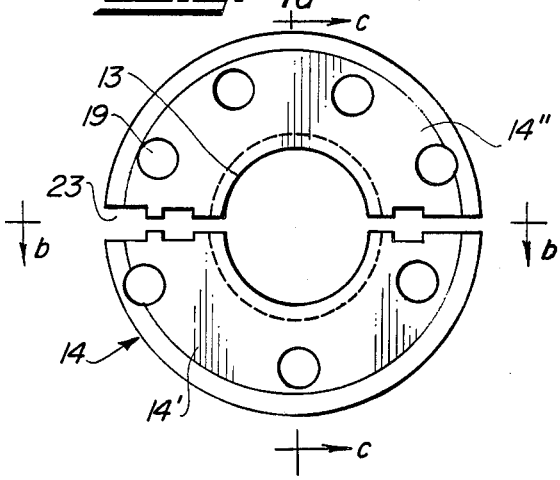
Figure 1C:
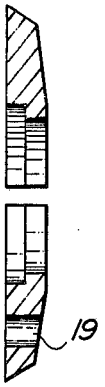

(*b*) a view of line b—b of FIG. 1; and (*c*) a sectional view of line c—c of FIG. 1(*a*).

Figure 2B:
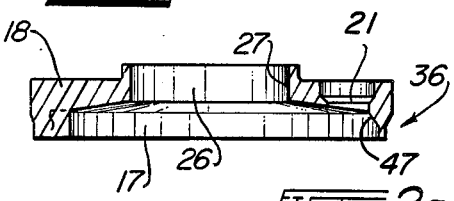
Figure 2A:
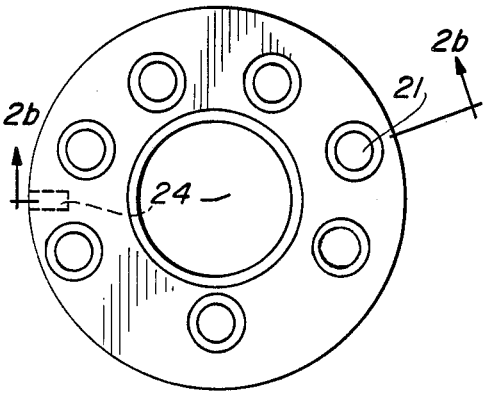

FIG. 2 shows an intermediate part of the present invention, shaped in the form of a dish in order to receive the underpiece shown in FIG. 1; by (*a*) a plan view; and (*b*) a sectional view along line 2*b*–2*b* of FIG. 2*a;*

Figure 3B:
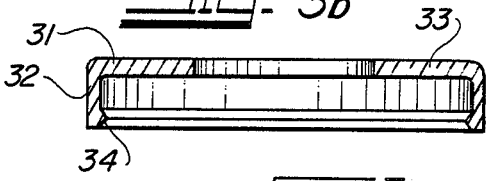
Figure 3A:
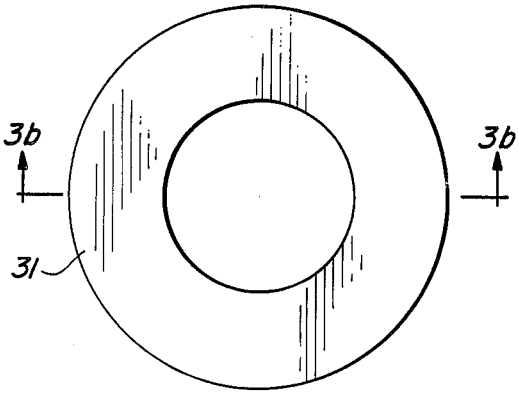

FIG. 3 shows an outer cover piece of the present invention, by (*a*) a plan view; and (*b*) a sectional view along line 3*b*–3*b* of FIG. 3*a;*

Figure 4:
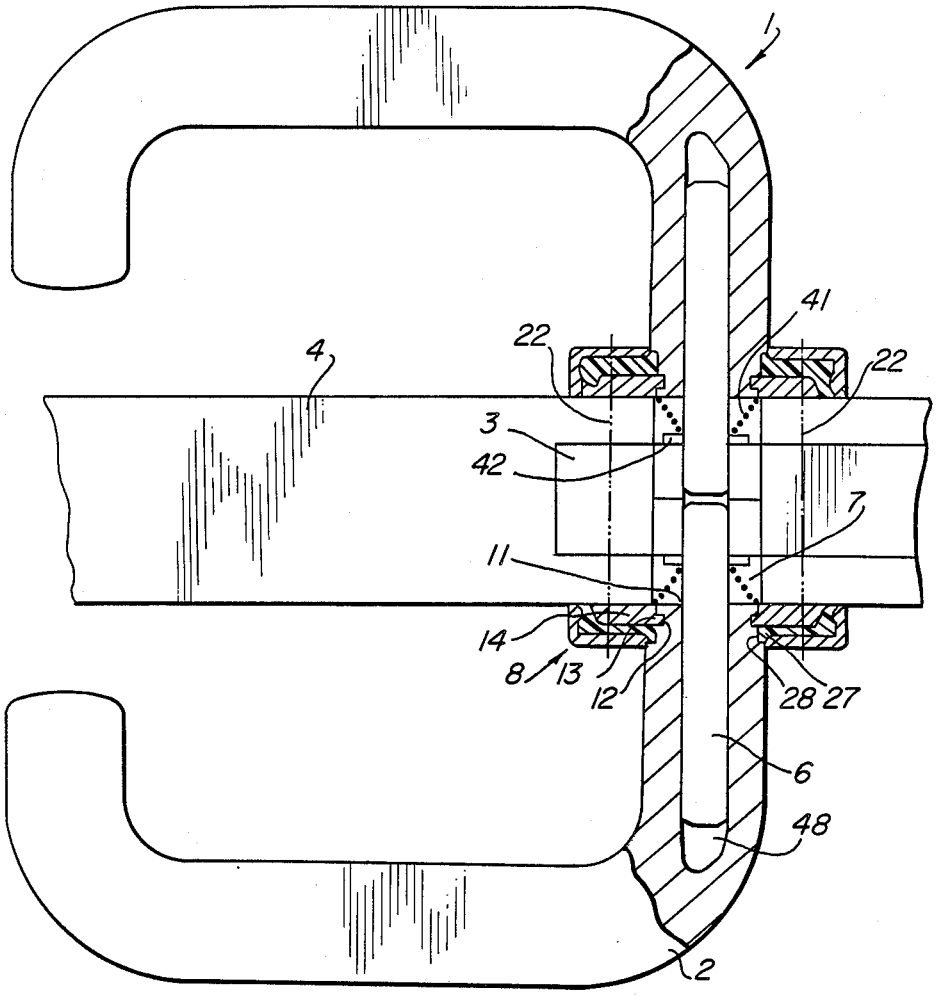

FIG. 4 is a partial cross-sectional view showing the door fitting of the present invention assembled with a door operating unit.

DETAILED DESCRIPTION OF THE DRAWINGS

According to the invention, a door fitting 1 has a closing device 3 (not further shown) in a door 4 to be activated by a knob or a handle. Using the knob or the handle, the closing device is activated by help of the polygonal spindle 6, which projects into the door through the opening 7 and into the closing device 3. According to the invention, the door fitting 1 is furthermore provided with cover plate 8 to cover the opening 7 in the door 4. In addition, according to the invention; the cover plate 8 serves to secure the door handle 2, especially in the axial direction of the spindle 6, i.e.; to prevent the door handle 2 from being pulled off the door. For this purpose, the door handle 2 has, most importantly, a circumferential groove 12 near the end to be attached to the door into which groove a corresponding circumferential shoulder 13 on the underpiece 14 of the cover plate 8 projects, and in this manner secures the handle part 2 in position when mounted. In the embodiment shown, the cover plate is shaped as a round collar.

The underpiece 14 consists of two halves 14' and 14", which are shaped as semicircles and have an attached shoulder 13 at their inner periphery. The side 16 to be placed against the door is even; the shape of the opposite side is adapted to a corresponding recess 17 in an intermediate part 18. The underpiece 14 has additional perforations 19, which correspond to the perforations 21 in the intermediate part 18 and serve as passages for screws used to secure the complete door fitting onto a door. The position of the screws is indicated by 22 in FIG. 4. In addition, each of the parts 14' and 14" has a radial notch 23 in the periphery which works together with a corresponding tap 24 on the intermediate part 18 to obtain relative angular alignment of the two parts 14 and 18; in such a manner that the perforations 19 and 21 are lined up.

The intermediate part 18 has a center opening 26 which is surrounded by a circular collar 27 extending axially which, when installed (see FIG. 4), rests against a shoulder 28 of the handle 2, thereby providing the handle with an additional hold against canting. The parts 14 and 18 are covered after installation and attachment to the door by help of screws with an outer cover 31; which essentially is shaped as a cylindrical pot with an outer wall 32 which, on the side facing away from the front side 33, is equipped with an inner circumferential shoulder 34. When the cover is attached on top; the shoulder rests behind a circumferential undercut 36 in the outer periphery of the intermediate part 18 so that the outer cover 31 is held in place by this snap-in connection. The outer cover 31 has essentially an ornamental function, i.e., it is used to cover up the part 14 which provides a hold for the handle 2 according to the invention.

A coil spring 41 surrounding the spindle 6 is positioned between the end 11 of the handle 2 and an abutment disk 42.

According to the invention, the installation of the fitting and the placement on the door take place in the following manner. First, the intermediate part 18 is pushed onto the shoulder 28 integral with the ring-shaped end 11 of the handle 2. Then the holding parts 14' and 14" are pushed into the recess 17 of the intermediate part 18, one after the other, in such a manner that their inner circumferential projecting rims 13 catch into the circumferential groove 12 of the handle part 2. This is easily done, particularly because of the slightly cone-shaped side walls 46 and 47 (inner circumference) of the parts 14 and/or 18. At this stage (i.e., still without the outer cover 31) the handle, with the parts 14 and 18 and one of the cover plates 8, can be pushed onto the polygonal spindle, preferably a square spindle 6; the corresponding hole 48 in the handle has a cross section which, likewise, is adapted to the spindle 6, thus preventing the spindle 6 and the handle 2 from twisting in relationship to each other. After assembly, the complete unit is screwed onto the door by help of screws passing through the perforations 19 and 21, and is held onto the door securely. Finally, the outer cover is pushed on and its circumferential projecting rim 34 catches into the undercut 36 of the part 18.

It is no longer possible to pull off the door handle. The door handle serves to open and close the door in the usual manner.

While a specific embodiment of the invention has been shown and described, it is to be understood that numerous changes and modifications thereof may be made without departing from the scope and spirit of the invention as set out in the appended claims.

What is claimed is:

1. In a door fitting with at least one door operating unit, such as a doorknob, a door handle or the like, and at least one cover plate means to cover the opening provided in a door, a window sash or the like for the door operating unit, in which the cover plate means has at least one circular opening for the door operating unit, the improvement comprising:

said door operating unit having a cylindrical circumferential groove in the area passing through the opening in the cover plate after mounting, and said cover plate means comprising at least two parts with curved recesses having inner shoulders which are adapted to said groove and which can be inserted into same, said curved recesses forming a circular opening in the cover plate when the parts are combined;

said cover plate means further comprising an additional part at least partially overlapping said at least two parts, said additional part having a dish-shaped recess adapted to the shape of said two parts to thereby radially hold together said two parts, each of said two parts and said additional part having cooperating means for securing said two parts in said additional part at the correct angle in relationship to each other.

2. The fitting according to claim 1, wherein said cooperating means of said additional part comprises a tap means in the periphery thereof, each said cooperating means of said at least two parts comprising a radial recess which together receive therein said tap means for proper alignment of said at least two parts in said additional part.

3. The fitting according to claim 1, wherein said additional part comprises a plurality of circumferentially-spaced holes, and said at least two parts comprising a plurality of circumferentially-spaced holes when said at least two parts are joined together in said additional part, whereby said cooperating means align said at least two parts and said additional part in order to align the corresponding holes of said at least two parts with said additional part, whereby screws may pass through said aligned holes for fastening said cover plate means to the door or like.

4. The fitting according to claim 3, wherein said circumferentially-spaced holes of said additional part are wider on the sides facing away from said at least two parts in order to receive the head of a fastening screw or the like.

5. The fitting according to claim 1, wherein said cover plate means further comprises an outer cover adapted to the shape of said additional part, and comprising a substantially central opening for the passage therethrough of a handle of said door operating unit.

6. The fitting according to claim 5, wherein said outer cover comprises a substantially cylindrically-shaped circumferential flange defining a peripheral beaded portion, said additional part having a cooperating circumferential recess at an end edge thereof for receiving said beaded portion of said circular outer cover to thereby removably lock in place said outer cover on said additional part.

* * * * *